US008123459B2

(12) United States Patent
Tomomatsu et al.

(10) Patent No.: US 8,123,459 B2
(45) Date of Patent: Feb. 28, 2012

(54) IMPELLER, FUEL PUMP HAVING THE IMPELLER, AND FUEL SUPPLY UNIT HAVING THE FUEL PUMP

(75) Inventors: Kenichi Tomomatsu, Kariya (JP); Tadashi Hazama, Chita-gun (JP); Eiji Iwanari, Chiryu (JP); Yuuji Nakazu, Kariya (JP); Hiromi Sakai, Nukata-gun (JP)

(73) Assignee: Denso Corporation, Kariya (JP)

( * ) Notice: Subject to any disclaimer, the term of this patent is extended or adjusted under 35 U.S.C. 154(b) by 795 days.

(21) Appl. No.: 12/203,275

(22) Filed: Sep. 3, 2008

(65) Prior Publication Data

US 2009/0060709 A1 Mar. 5, 2009

(30) Foreign Application Priority Data

Sep. 3, 2007 (JP) ..... 2007-227717
Jun. 27, 2008 (JP) ..... 2008-168445

(51) Int. Cl.
*F01D 1/12* (2006.01)

(52) U.S. Cl. ..... 415/58.4; 415/58.7

(58) Field of Classification Search ..... 415/58.4, 415/58.7

See application file for complete search history.

(56) References Cited

U.S. PATENT DOCUMENTS 5,596,970 A 1/1997 Schoenberg et al.
6,179,579 B1 1/2001 Dobler et al.
6,425,734 B2 7/2002 Marx
7,037,066 B2 * 5/2006 Moss ..... 415/55.1
2003/0231952 A1 12/2003 Moss
2005/0226715 A1 10/2005 Inuzuka et al.
2007/0104567 A1 5/2007 Narisako et al.

FOREIGN PATENT DOCUMENTS

JP 46-33853 10/1971
JP 63-071592 3/1988
JP 2005-337165 12/2005

OTHER PUBLICATIONS

Chinese Office Action dated Jun. 29, 2010, issued in corresponding Chinese Application No. 200810213380.1, with English translation.
Korean Office Action dated Aug. 27, 2010, issued in corresponding Korean Application No. 10-2008-0086245, with English translation.
Japanese Office Action dated Aug. 25, 2009, issued in corresponding Japanese Application No. 2008-168445, with English translation.

* cited by examiner

*Primary Examiner* — Jarrett Stark
*Assistant Examiner* — Nicholas Tobergte
(74) *Attorney, Agent, or Firm* — Nixon & Vanderhye, PC

(57) ABSTRACT

A fuel pump has substantially coaxial outer and inner pump chambers. An impeller has partition walls correspondingly to the inner pump chamber to define inner vane grooves. A rear surface is located at a rear side in a rotative direction of each inner vane groove. At least a radially inner side of the rear surface inclines rearward in the rotative direction from the radially inner side to a radially outer side. A first line connects a radially inner end of the rear surface with a radially outer end of the rear surface. A second line radially extends from the radially inner end of the rear surface. The first line and the second line therebetween define a backward tilt angle $\alpha 2$, which satisfies a relationship of $30° \leqq \alpha 2 \leqq 80°$.

5 Claims, 15 Drawing Sheets

IMPELLER, FUEL PUMP HAVING THE IMPELLER, AND FUEL SUPPLY UNIT HAVING THE FUEL PUMP

CROSS REFERENCE TO RELATED APPLICATIONS

This application is based on and incorporates herein by reference Japanese Patent Applications No. 2007-227717 filed on Sep. 3, 2007 and No. 2008-168445 filed on Jun. 27, 2008.

FIELD OF THE INVENTION

The present invention relates to an impeller for a fuel pump. The present invention further relates to a fuel pump having the impeller. The present invention further relates to a fuel supply unit having the fuel pump.

BACKGROUND OF THE INVENTION

A turbine-type fuel pump known in the past is mounted in a fuel pump of a vehicle so as to feed fuel under pressure into a vehicle engine.

Such a type of fuel pump is mounted within a sub-tank provided on a bottom of a fuel tank. In the present structure, even when a vehicle turns or goes up a slope, and a liquid level of fuel in a fuel tank tilts, or even when the liquid level of fuel in the fuel tank is reduced by the fuel consumption, fuel is securely drawn or discharged. The sub-tank is a fuel container that is filled with fuel from a fuel tank, so that the fuel container can store fuel at a liquid level independent of a liquid level in the fuel tank.

As a structure for filling the sub-tank with fuel, for example, U.S. Pat. No. 5,596,970 discloses pump chambers of a fuel pump. The pump chambers of a fuel pump are coaxially formed in two rows. In the present structure, an outer pump chamber provided at an outer side is used for feeding fuel under pressure into a vehicle engine, and an inner pump chamber provided at an inner side is used for filling the sub-tank with fuel. Furthermore, JP-A-2007-132196 discloses enhancement of pump efficiency of a fuel pump by specifying a backward tilt angle or a forward tilt angle of a rear surface located at a rear side in a rotation direction of a vane groove of an impeller. The backward tilt angle of the rear surface is defined between a line, which connects a radially inner end of the rear surface with a radially outer end of the rear surface, and a line extending in a radial direction from the radially inner end. The forward tilt angle of the rear surface is defined between a line, which connects a center in a rotation axis direction of the rear surface with one of ends in the rotation axis direction of the rear surface, and a line extending in a rotational tangent direction from the center in the rotation axis direction of the rear surface.

As in U.S. Pat. No. 5,596,970, when pump chambers are coaxially formed in two rows, and an inner pump chamber is used for filling the sub-tank with fuel, circumferential speed of an impeller decreases in the inner pump chamber compared with in the outer pump chamber. Therefore, suction negative-pressure is reduced in the inner pump chamber compared with in the outer pump chamber.

Therefore, for example, when residual quantity of fuel in a fuel tank decreases, so that a liquid level of fuel in the fuel tank is reduced compared with a pump mounting position, and finally fuel runs out of the inner pump chamber, suction negative-pressure in the inner pump chamber becomes extremely low. Consequently, fuel cannot be drawn up from the fuel tank into the inner pump chamber. Even when fuel can be drawn up into the inner pump chamber at low suction negative-pressure, unless gas (air) is exhausted from the inner pump chamber to produce a pump effect, the fuel cannot be pumped up into the sub-tank.

In order to solve the present problem, a vane groove configuration disclosed in JP-A-2007-132196 may be applied as a vane groove configuration of the impeller for the inner pump chamber in U.S. Pat. No. 5,596,970 so as to enhance pump efficiency. However, in the present combination, fuel to be pumped up into the sub-tank is rather excessively boosted in pressure. Such excessive boost in pressure leads to increase in drive torque of a fuel pump, causing increase in current consumption.

SUMMARY OF THE INVENTION

In view of the foregoing and other problems, it is an object of the present invention to produce a fuel pump impeller configured to steadily pump fuel with low torque. It is another object of the present invention to produce a fuel pump having the impeller and configured to steadily pump fuel with low torque. It is another object of the present invention to produce a fuel supply unit having the fuel pump and configured to steadily pump fuel with low torque.

According to one aspect of the present invention, an impeller for a fuel pump having an outer pump chamber and an inner pump chamber being substantially coaxial with each other, the impeller comprises a plurality of partition walls provided at least in a region corresponding to the inner pump chamber and arranged in the rotative direction, each of the plurality of partition walls partitioning inner vane grooves, which are adjacent to each other. A rear surface is located at a rear side in a rotative direction of each of the inner vane grooves. At least a radially inner side of the rear surface inclines rearward in the rotative direction from a radially inner side to a radially outer side. A first line connects a radially inner end of the rear surface with a radially outer end of the rear surface. A second line extends in a radial direction from the radially inner end of the rear surface. The first line and the second line therebetween define a backward tilt angle $\alpha 2$. The backward tilt angle $\alpha 2$ satisfies a relationship of $30° \leqq \alpha 2 \leqq 80°$.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

A fuel supply unit 1 for a vehicle of the present embodiment is described according to FIGS. 1 to 7.

Figure 1:
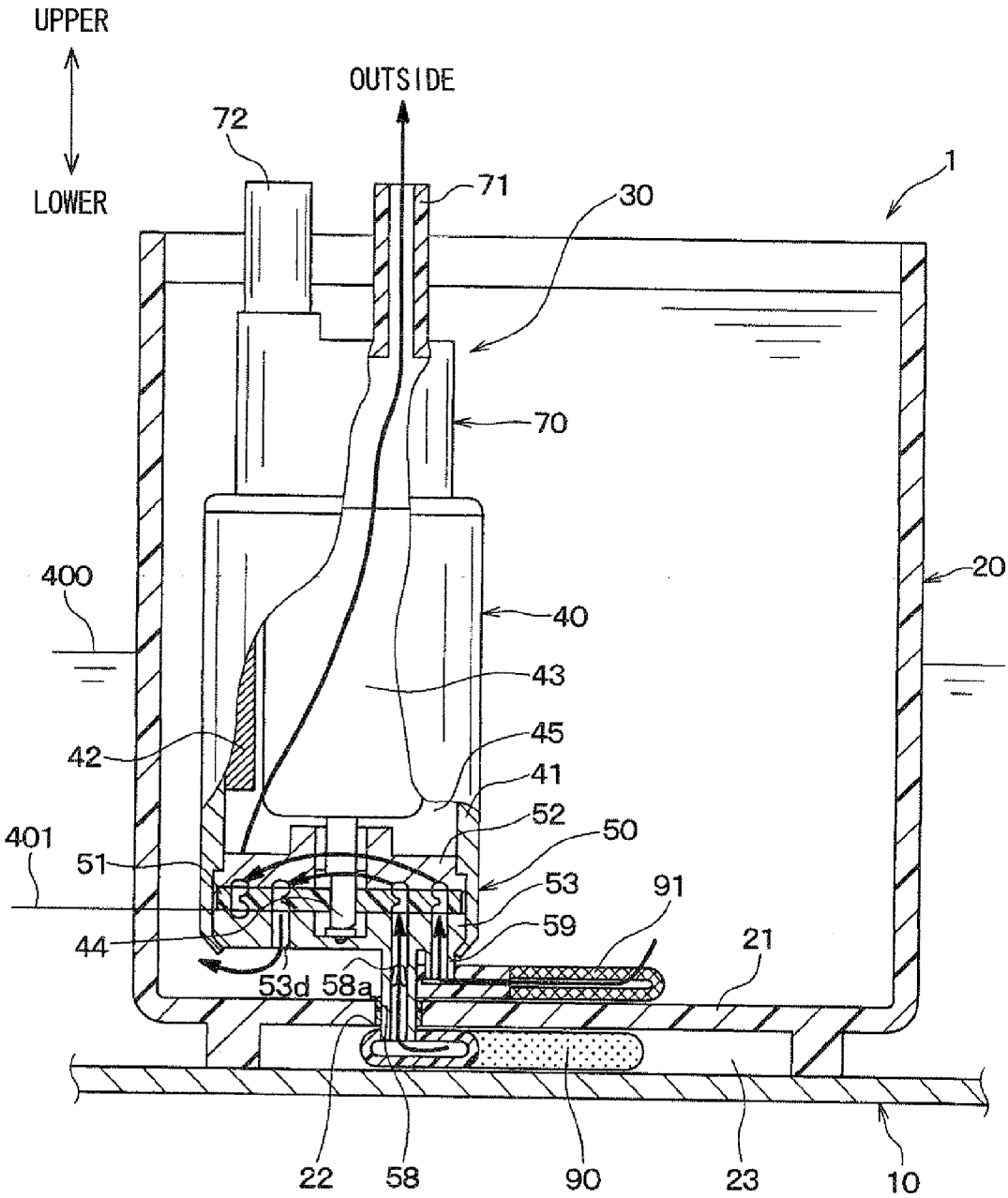
FIG. 1 is a cross sectional view showing a fuel supply unit of a first embodiment.

As shown in FIG. 1, the fuel supply unit 1 is accommodated in a fuel tank 10 to supply fuel from the fuel tank 10 into a fuel consumption unit outside the fuel tank 10. In the present embodiment, the fuel consumption unit is, for example, a vehicle engine. The fuel supply unit 1 has a sub-tank 20, which is provided on a bottom of the fuel tank 10, and a fuel pump 30, which is accommodated in the sub-tank 20.

The fuel tank 10 is for storing fuel. In the present embodiment, the fuel is, for example, gasoline. The subtank 20 is a fuel container that is provided on the bottom of the fuel tank 10 so that the sub-tank 20 can store fuel at a liquid level, independent of a liquid level of fuel in the fuel tank 10.

Specifically, the sub-tank 20 is formed of resin in a bottomed, cylindrical or box-like shape. In the present embodiment, the sub-tank 20 is in a cylindrical shape. A through hole 22 is provided in a bottom (sub-tank bottom) 21 of the sub-tank 20, and the inside of the fuel tank 10 communicates with the inside of the sub-tank 20 via the through hole 22.

A gap space 23 is formed between the sub-tank bottom 21 and the bottom of the fuel tank 10. The gap space 23 is formed in a size that enables accommodation of a suction filter 90, which filtrates fuel flowing into the fuel pump 30 to remove a foreign substance, and the gap space communicates with the inside of the fuel tank 10.

The through hole 22 is inserted with an inner suction tube 58 that communicates with an inner pump chamber 50*b* of the fuel pump 30 described later. The inner suction tube 58 extends into the gap space 23 and is connected to the suction filter 90.

A check valve 58*a* is provided within the inner suction tube 58, which allows fuel to flow substantially only from a gap space 23 to an inner pump chamber 50*b*. The check valve 58*a* restricts backflow of fuel from the sub-tank 20 into the fuel tank 10 via the inner pump chamber 50*b* and the inner suction tube 58.

A suction filter 91 is also provided on an upper surface of the sub-tank bottom 21 in the sub-tank 20 for filtrating fuel flowing into the fuel pump 30 to remove a foreign substance. The suction filter 91 is connected to an outer suction tube 59 that communicates with an outer pump chamber 50*a* of the fuel pump 30 described later.

The fuel pump 30 is configured to have a motor portion 40, a pump portion 50, a resin cover end 70, and the like. The motor portion 40 is supplied with electric power for rotation. The pump portion 50 is supplied with rotational drive force from the motor portion 40 for drawing and discharging fuel. The resin cover end 70 forms a discharge passage for guiding fuel discharged from the pump portion 50 from the inside of the fuel pump 30 to the outside of the fuel tank 10.

First, the motor portion 40 is a known DC electromotive motor with brushes. Specifically, the motor portion is in a configuration where an armature 43 is rotatably provided at the radially inner side of permanent magnets 42, which are provided annually along an inner circumferential surface of a cylindrical housing 41. Further, a coil (not shown) of the armature 43 is applied with an electric current whereby the armature 43 itself rotates. A brushless motor may be used for the motor portion 40.

The coil of the armature 43 is supplied with electric power from an external power supply via a terminal of a connector portion 72 provided on the cover end 70, brushes provided in the cover end 70, and a commutator provided in the armature 43 (any of them is not shown). The cover end 70 is fixed to one end side of the housing 41 by being caulked or the like. More specifically, the cover end 70 is fixed to an upper end side of the housing 41 in a mounting condition as shown in FIG. 1.

A rotational shaft 44 of the armature 43 is supported by a bearing provided in the center of both the cover end 70 and the pump portion 50. Furthermore, an end of the rotational shaft 44 at the side of the pump portion 50 of the rotational shaft 44 is connected to an impeller 51 of the pump portion 50.

In the present structure, when the motor portion 40 is applied with an electric current to rotate the armature 43, the impeller 51 rotates together with the armature 43, so that the pump portion 50 conducts a pump operation. Fuel, which has flowed from the pump portion 50 into a fuel chamber 45 in the housing 41 by the pump operation of the pump portion 50, flows out to the outside of the fuel tank 10 through a discharge passage formed in a cylindrical discharge port 71 of the cover end 70.

The pump portion 50 is configured to have the impeller 51, a pump chamber casing 52, and a pump chamber cover 53. More specifically, the impeller 51 is rotatably accommodated about the rotational shaft 44 within a casing formed by the pump chamber casing 52 and the pump chamber cover 53.

Figure 3A:
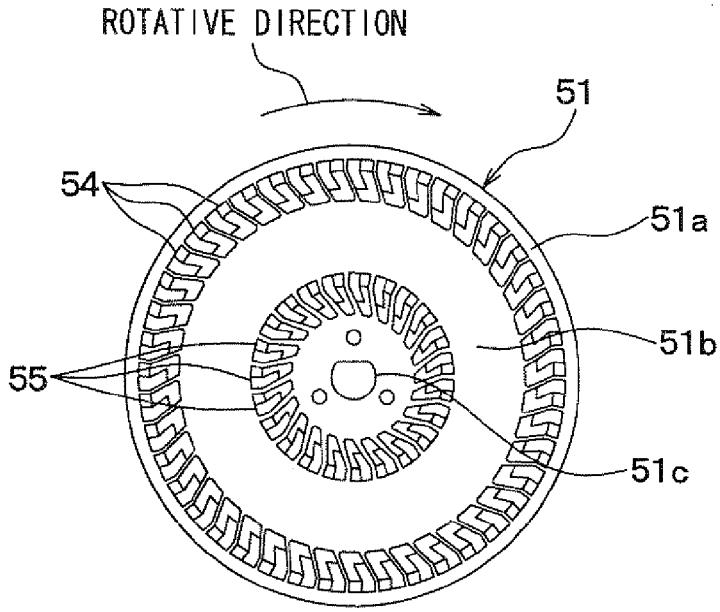
FIG. 3A shows a general front view of an impeller in the first embodiment.
Figure 3B:
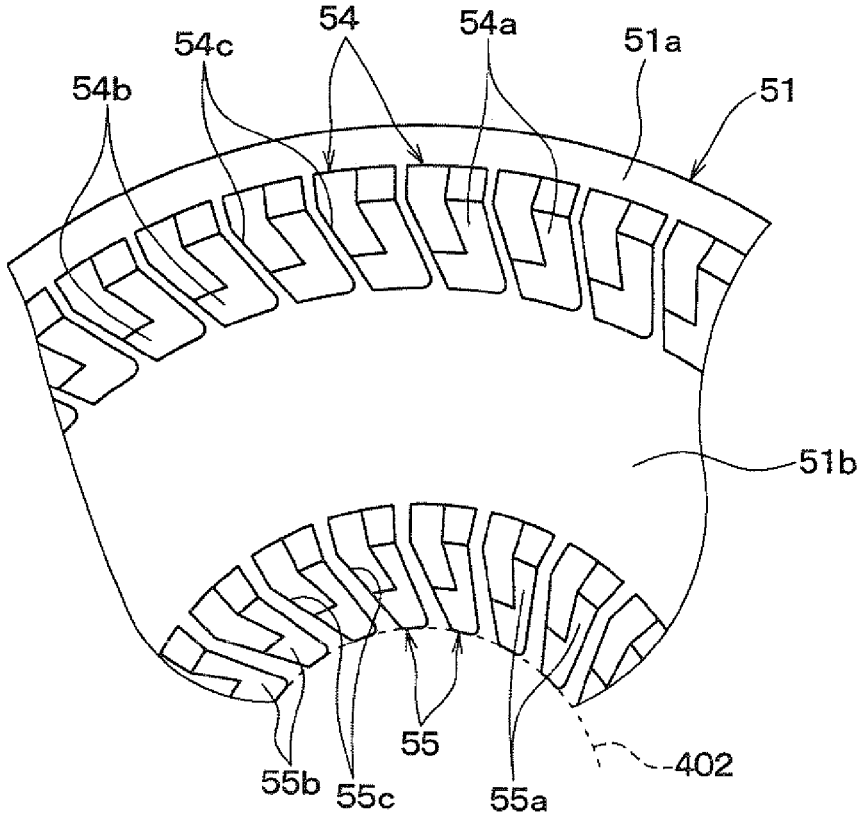
FIG. 3B shows an enlarged view of FIG. 3A.
Figure 4:
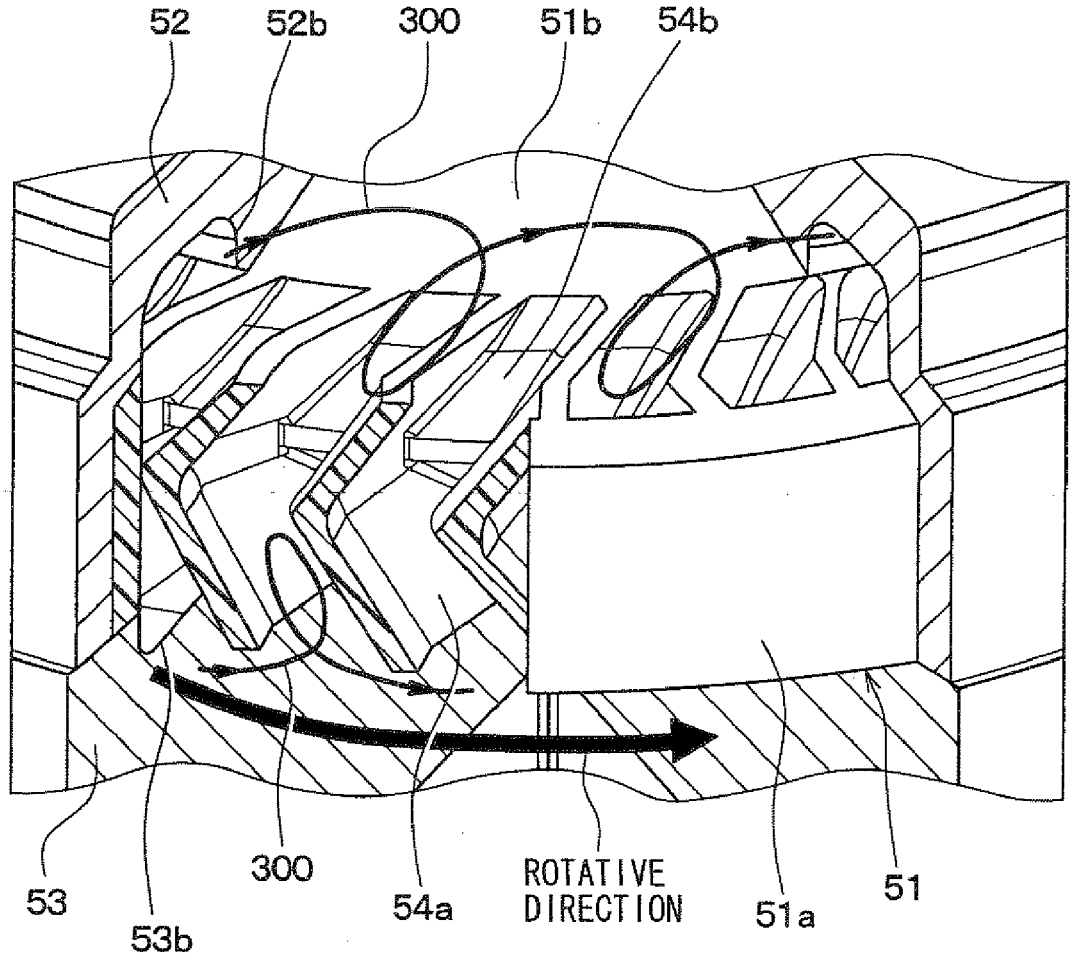
FIG. 4 is an oblique cross sectional view showing the pump portion of the fuel pump of the first embodiment.

The impeller 51 is described in detail according to FIGS. 3 to 6. FIG. 3A shows a general front view of the impeller 51 seen in a rotation axis direction. FIG. 3B shows an enlarged view of the periphery of the impeller 51 of FIG. 3A. FIG. 4 shows an oblique cross sectional view in a condition that the impeller 51 is accommodated in the casing.

The impeller 51 is a disk-shaped member formed of resin. As shown in FIGS. 3A, 3B, the impeller 51 has multiple outer vane grooves 54 and inner vane grooves 55 formed thereon for transmitting momentum to fuel. The outer vane grooves 54 and the inner vane grooves 55 are coaxially provided in two rows in a rotative direction.

More specifically, a ring 51*a* is provided at an outermost circumference of the impeller 51. The outer vane grooves 54 are provided at a radially inner side of the ring 51*a*. The inner vane grooves 55 are provided at a radially inner side of the outer vane grooves 54.

First, the outer vane grooves 54 are described. As shown in FIGS. 3A, 3B, and 4, the outer vane grooves 54 adjacent to each other in a rotative direction are partitioned by a V-shape partition wall 54*a*. As shown in FIG. 4, the V-shape partition wall 54*a* inclines forward in the rotative direction from approximately the center in a rotation axis direction (thickness direction) of the impeller 51 to an end face 51*b* at both sides in the rotation axis direction of the impeller 51. That is, the partition wall 54*a* is formed substantially in the V shape such that both the sides of the end face 51*b* inclines forward in the rotative direction in a cylindrical section around a rotation axis.

In each of the outer vane grooves 54, a partition wall protrudes from a radially inner side of the outer vane groove 54 to a radially outer side thereof. The partition wall 54*b* partitions a part of the groove 54 at the radially inner side in the rotation axis direction. Therefore, in a radially outer side of the partition wall 54*b* of the outer vane groove 54, both spaces defined by the end faces 51*b* of the impeller 51 communicate with each other.

Figure 5:
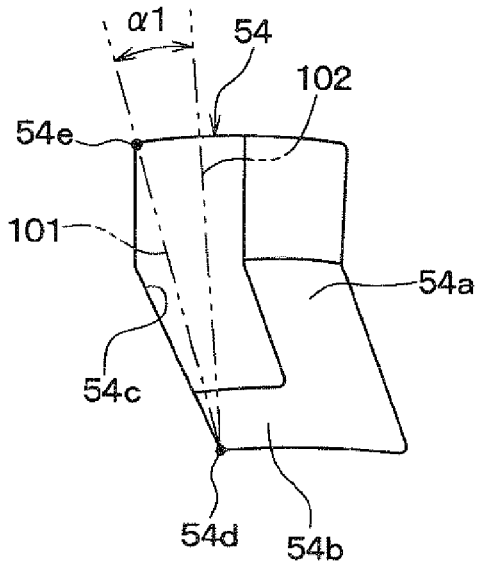
FIG. 5 is an enlarged view of an outer vane groove in the impeller of the first embodiment.

Furthermore, as shown in the enlarged view of the outer vane groove 54 of FIG. 5, in a rear surface 54*c* located at a rear side in the rotative direction of the outer vane groove 54, at least a radially inner side inclines rearward in the rotative direction from the radially inner side to the radially outer side. That is, in a surface located at a front side in the rotative direction of the partition wall 54*a*, at least the radially inner side inclines rearward in the rotative direction from the radially inner side to the radially outer side.

A backward tilt angle $\alpha 1$ is defined between a line 101 and a line 102. The line 101 connects a radially inner end 54*d* of the rear surface 54*c* to a radially outer end 54*e* thereof in a plane perpendicular to the rotation axis. The line 102 extends in a radial direction of the impeller 51 from the radially inner end 54*d*. The backward tilt angle $\alpha 1$ is approximately in a range of $15° \leqq \alpha 1 \leqq 30°$.

Next, the inner vane grooves 55 are described. A configuration of the inner vane grooves 55 is basically the same as that of the outer vane grooves 54. Specifically, the inner vane grooves 55 adjacent to each other in the rotative direction are partitioned by a V-shape partition wall 55*a* that inclines forward in the rotative direction. A part of each inner vane groove 55 at the radially inner side is partitioned by a partition wall 55*b*.

Figure 6:
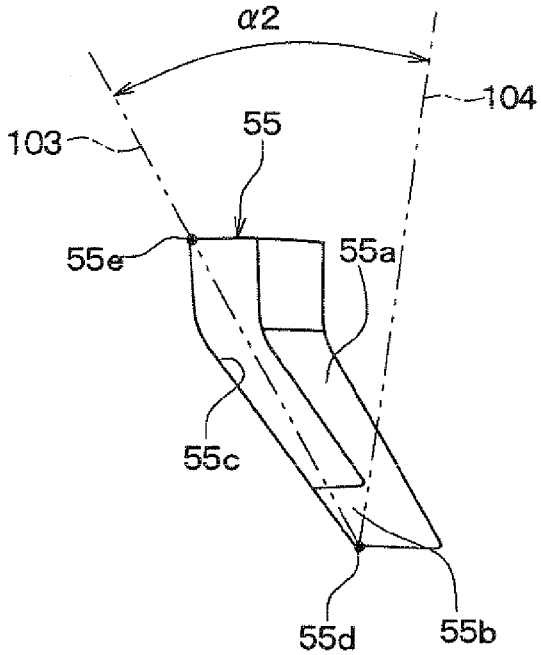
FIG. 6 is an enlarged view of an inner vane groove of the impeller in the first embodiment.

Furthermore, as shown in the enlarged view of the inner vane groove 55 of FIG. 6, in a rear surface 55*c* located at a rear side in the rotative direction of the inner vane groove 55, at least a radially inner side inclines rearward in the rotative direction from the radially inner side to a radially outer side. That is, in a surface located at a front side in the rotative direction of the partition wall 55*a*, at least the radially inner side inclines rearward in the rotative direction from the radially inner side to the radially outer side.

A backward tilt angle $\alpha 2$ is defined between a line (first line) 103 and a line (second line) 104. The line 103 connects a radially inner end 55*d* of the rear surface 55*c* with a radially outer end 55*e* thereof in a plane perpendicular to the rotation axis. The line 104 extends in a radial direction of the impeller 51 from a radially inner end 55*d*. The backward tilt angle $\alpha 2$ is approximately in a range of $30° \leqq \alpha 2 \leqq 80°$.

Referring to FIG. 3, a D-shape hole 51*c* is formed at a radially inner side of each inner vane groove 55 of the impeller 51. The D-shape hole 51*c* penetrates through both end faces 51*b* of the impeller 51. The D-shape hole 51*c* is fitted with a substantially D-shaped portion of the rotational shaft 44 of the motor portion 40.

Figure 2:
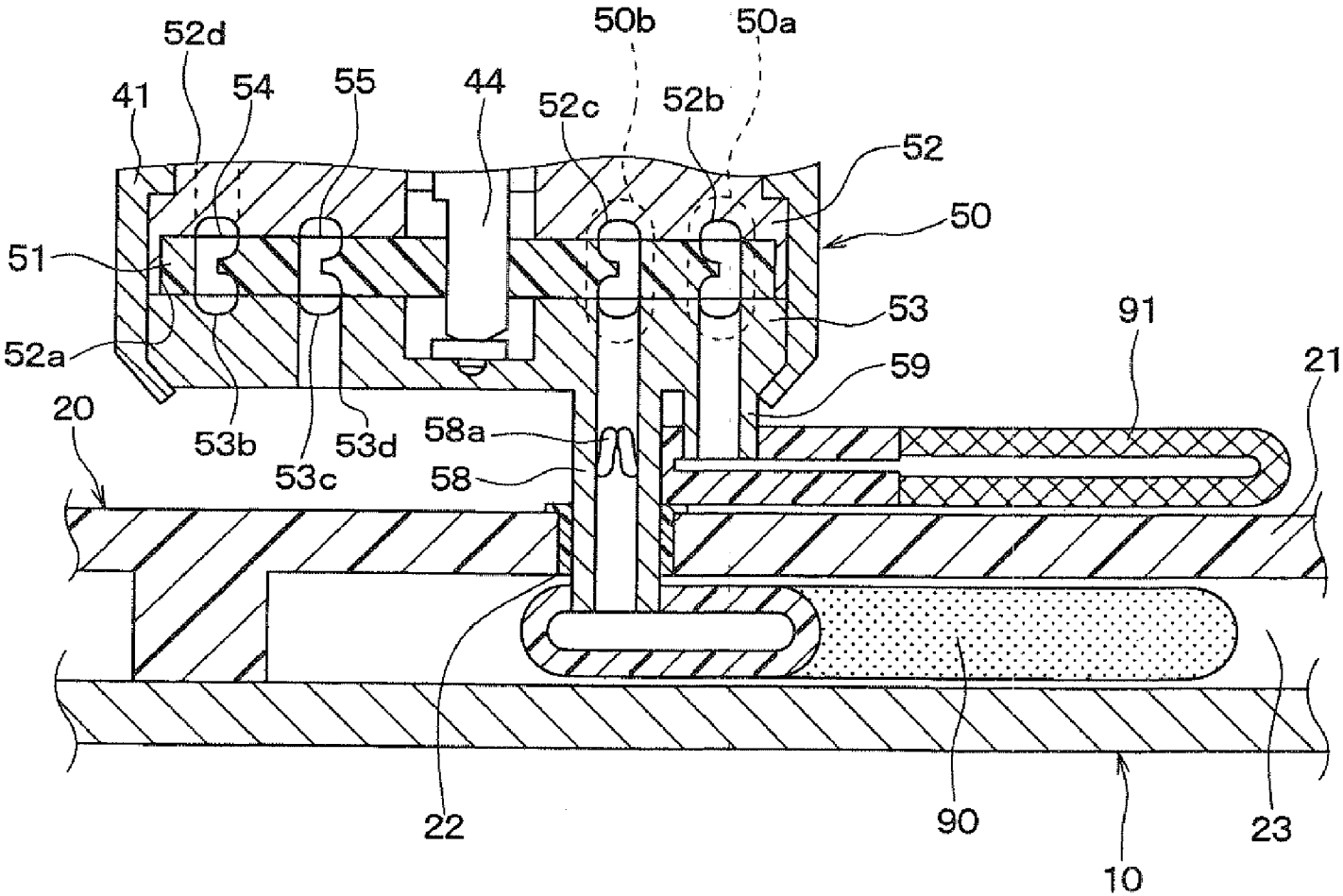
FIG. 2 is an enlarged cross sectional view showing the periphery of a pump portion of a fuel pump of the fuel supply unit of the first embodiment.

As shown in FIG. 2, a pump chamber casing 52 and a pump chamber cover 53 are formed of metal typified by aluminum (for example, aluminum dye cast), or a resin material having excellent fuel resistance and high strength. First, the pump chamber casing 52 is formed substantially in a cylindrical shape for accommodating the impeller 51. A concave portion 52*a* is formed within the pump chamber casing 52.

The concave portion 52*a* has a depth in the rotation axis direction, and the depth is deeper by about 5 μm to 50 μm than a thickness of the impeller 51. In the present structure, a dimension in the rotation axis direction of the casing formed by the pump chamber casing 52 and the pump chamber cover 53 and a dimension in the rotation axis direction of the impeller 51 are set to therebetween define a predetermined gap.

Furthermore, an outer pump channel 52*b* and an inner pump channel 52*c* are arcuately formed substantially in a surface of the concave portion 52*a* over a predetermined angle range, the surface facing the impeller 51. The channels allow passage of fuel in accordance with a rotation of the impeller 51.

The outer pump channel 52*b* and the inner pump channel 52*c* are formed at positions respectively corresponding to arrays of the outer vane grooves 54 and the inner vane grooves 55 of the impeller 51. A discharge port 52*d* for a fuel chamber is provided at a trailing end in the rotative direction of the outer pump channel 52*b* of the pump chamber casing 52. The discharge port 52*d* communicates with the fuel chamber 45 in the housing 41.

On the other hand, the pump chamber cover 53 is formed approximately in a disk shape, and fixed by being caulked or the like together with the pump chamber casing 52. The pump chamber cover 53 is provided at a lower end side in the mounting condition shown in FIG. 1 and located at the side opposite to a side where the cover end 70 of the housing 41 is mounted. The pump chamber cover 53 is positioned at a predetermined location with respect to the pump chamber casing 52.

In a surface facing the impeller 51 of the pump chamber cover 53, as shown in FIG. 2, an outer pump channel 53*b* and an inner pump channel 53*c* are also arcuately formed over a predetermined angle range. In the present structure, the channels allow passage of fuel in accordance with rotation of the impeller 51. The outer pump channel 53*b* and the inner pump channel 53*c* are also formed respectively at positions corresponding to arrays of the outer vane grooves 54 and the inner vane grooves 55 of the impeller 51.

In the pump chamber cover 53, the outer suction tube 59 and the inner suction tube 58 are integrally formed. In addition, a leading end of the outer pump channel 53*b* in the rotative direction of the impeller 51 communicates with a suction passage in the outer suction tube 59, and a leading end in the rotative direction of the inner pump channel 53*c* communicates with a suction passage in the inner suction tube 58. Furthermore, a discharge port for sub-tank 53*d* communicating with the sub-tank 20 is provided at a trailing end in the rotative direction of the inner pump channel 53*c*.

In the present structure, an outer pump chamber 50*a* is formed by the outer pump channel 52*b* of the pump chamber casing 52, outer vane grooves 54 of the impeller 51, and outer pump channel 53*b* of the pump chamber cover 53. Moreover, an inner pump chamber 50*b* is formed by the inner pump channel 52*c* of the pump chamber casing 52, inner vane grooves 55 of the impeller 51, and inner pump channel 53*c* of the pump chamber cover 53.

Furthermore, in the present embodiment, similarly to the described U.S. Pat. No. 5,596,970, the inner pump chamber 50*b* is used for filling the sub-tank 20 with fuel supplied from the fuel tank 10, and the outer pump chamber 50*a* is used for feeding fuel under pressure from the sub-tank 20 into the fuel consumption unit.

Next, description is made on an operation of the fuel supply unit of the present embodiment having the above configuration. When a not-shown vehicle start switch is turned on, so that electric power is supplied from the battery to the fuel pump 30 via the connector 72, the armature 43 of the motor portion 40 rotates. Then, the impeller 51 rotates together with the rotational shaft 44 of the armature 43.

When the impeller 51 rotates, and thus the inner pump chamber 50*b* conducts a pump operation, fuel in the fuel tank 10 sequentially flows through the gap space 23, the suction filter 90, the inner suction tube 58, the inner pump chamber 50*b*, and the discharge port 53*d* for the sub-tank 20, and finally fills the sub-tank 20.

Furthermore, when the outer pump chamber 50*a* conducts a pump operation, fuel in the sub-tank 20 sequentially flows through the suction filter the outer suction tube 59, the outer pump chamber 50*a*, and the discharge port 52*d* for the fuel chamber 45, and finally is discharged into the fuel chamber 45. The fuel discharged into the fuel chamber 45 passes through the periphery of the armature 43 while cooling the armature 43, and is led out to the outside of the fuel tank 10 from the cylindrical discharge port 71.

Here, a principle of the operation of the fuel pump 30 in the present embodiment is described. Since the principle of the operation of the outer pump chamber 50*a* is essentially the same as that of the inner pump chamber 50*b*, only the principle of the operation of the outer pump chamber 50*a* is described according to FIG. 4.

Fuel drawn from the outer suction tube 59 into the outer pump chamber 50*a* flows through the outer pump channels 52*b* and 53*b* from a side of the outer suction tube 59 to a side of the discharge port 52*d* for the fuel chamber 45 in accordance with rotation of the impeller 51. In such flow of fuel, fuel flows while being guided by the partition wall 54*b* to cause a swirl flow 300 where fuel rotates symmetrically between both sides in the rotation axis direction of the impeller 51.

By producing the swirl flow 300, fuel repeats flowing from the outer pump channels 52*b* and 53*b* into each outer vane groove 54 and flowing from each outer vane groove 54 into the outer pump channels 52*b* and 53*b*. Whereby, momentum in the rotative direction is transmitted from the outer vane groove 54 to the fuel, so that the fuel is increased in pressure.

In the present embodiment, since the backward tilt angle $\alpha 1$ of the outer vane groove 54 is set to be in the range about $15° \leqq \alpha 1 \leqq 30°$ as described before, high pump efficiency can be produced by the outer pump chamber 50*a* as previously disclosed in U.S. Pat. No. 5,596,970. On the other hand, since the backward tilt angle $\alpha 2$ of the inner vane groove 55 is set to be in the range of $30° \leqq \alpha 2 \leqq 80°$, suction negative-pressure required for pumping up fuel into the inner pump chamber 50*b* can be stably generated.

Figure 7:
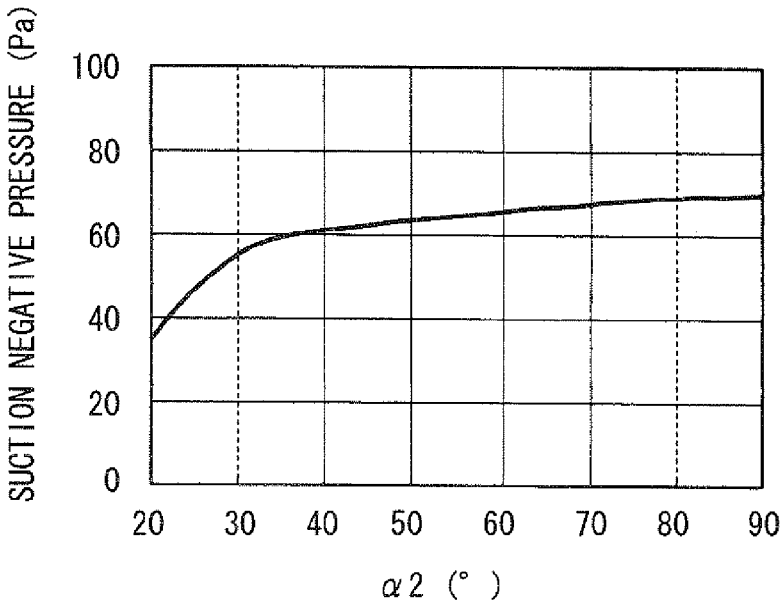
FIG. 7 is a graph showing a relationship between a backward tilt angle $\alpha 2$ and suction negative-pressure.

The present operation is described in a more detailed manner according to FIG. 7. FIG. 7 is a graph showing a relationship between the backward tilt angle $\alpha 2$ of the inner vane groove 55 and the suction negative-pressure. More specifically, the graph shows a result of measurement of suction negative-pressure in the case where the impeller 51 idled at 5000 rpm when the fuel liquid level 400 shown in FIG. 1 is lower than a pump mounting position 401, and gas (air) fills the inner pump chamber 50*b*. The pump mounting position 401 corresponds to a lowermost surface position of the impeller 51.

As indicated by FIG. 7, the backward tilt angle $\alpha 2$ is set to be $30° \leqq \alpha 2$, thereby stable suction negative-pressure required for pumping up fuel into the inner pump chamber 50*b* can be generated. On the other hand, when the angle $\alpha 2$ is set to be $\alpha 2 \leqq 30°$, the sub-tank 20 cannot be filled with fuel since suction negative-pressure is small, and fuel cannot be sufficiently drawn up.

When the angle $\alpha 2$ is set to be $80° < \alpha 2$, the rear surface 55*c* of the inner vane groove 55 cannot be effectively formed since the rear surface 55*c* of each inner vane groove 55 inclines rearward in the rotative direction (radially inner side) compared with a tangent of an inscribed circle 402 formed by ends at inner diameter sides of the inner vane grooves shown in FIG. 3B. Therefore, the backward tilt angle $\alpha 2$ of the inner vane groove 55 is set to be $30° \leqq \alpha 2 \leqq 80°$, thereby even when fuel does not exist in the inner pump chamber 50*b*, fuel can be pumped up from the fuel tank 10 into the sub-tank 20.

Furthermore, the inner pump chamber 50*b* is provided at a radially inner side compared with the outer pump chamber 50*a*. Therefore, in the outer pump chamber 50*a*, circumferential speed of the impeller 51 is used to efficiently increase pressure of fuel so that fuel can be fed under pressure from the sub-tank 20 to the outside of the fuel tank 10. In addition, in the inner pump chamber 50*b*, unnecessary boost of fuel pressure can be restricted.

As a result, increase in drive torque is suppressed in the inner pump chamber 50*b*, and consequently fuel can be pumped up from the fuel tank 10 into the sub-tank 20 at low torque.

Second Embodiment

In the first embodiment, a basic configuration of the inner vane grooves 55 is substantially the same as that of the outer vane groove 54, and the outer and inner vane grooves 54, 55 respectively have the backward tilt angles $\alpha 1$ and $\alpha 2$ being different from each other. On the contrary, in the present embodiment, as shown in FIG. 8A, 8B, description is made on an example where inner vane grooves 55*x* having a different configuration from that of the outer vane grooves 54 in the first embodiment are used.

Figure 8A:
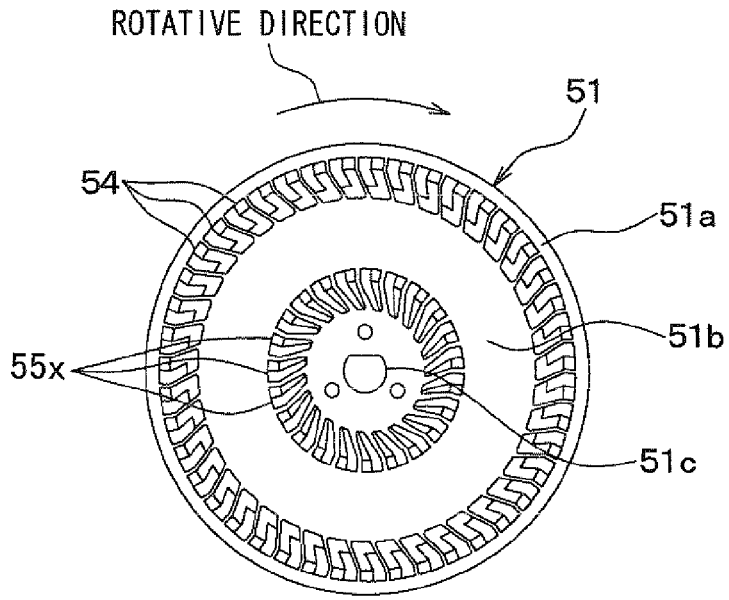
FIG. 8A shows a general front view of an impeller in a second embodiment.
Figure 8B:
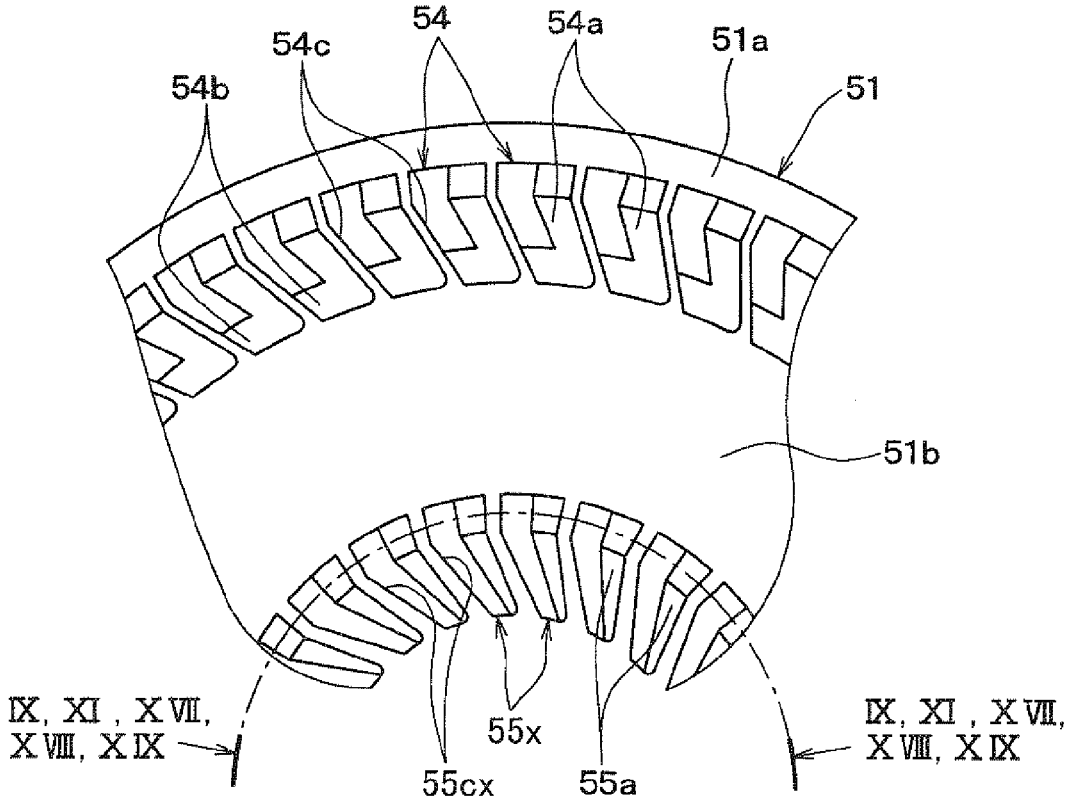
FIG. 8B shows an enlarged view of FIG. 8A.

FIG. 8A, 8B shows views respectively corresponding to FIGS. 3A, 3B in the first embodiment, wherein FIG. 8A shows a general front view seen in the rotation axis direction of the impeller 51 in the present embodiment, and FIG. 8B shows an enlarged view of the periphery of the impeller 51 of FIG. 8A. In FIG. 8A, 8B, portions, which are substantially similar to or equal to those in the first embodiment, are denoted with the identical signs respectively. This is substantially the same in other embodiments described below.

As shown in FIG. 8A, 8B, the partition wall 55*b* is not provided in each of the inner vane grooves 55*x* in the present embodiment. Therefore, the swirl flow 300 described in FIG. 4 is hardly generated in an inner pump chamber 50*b* in the present embodiment compared with the structure in the first embodiment. Furthermore, a rear surface 55*cx* of the inner vane groove 55*x* inclines rearward in the rotative direction from one end side to the other end in the rotation axis direction.

Figure 9:
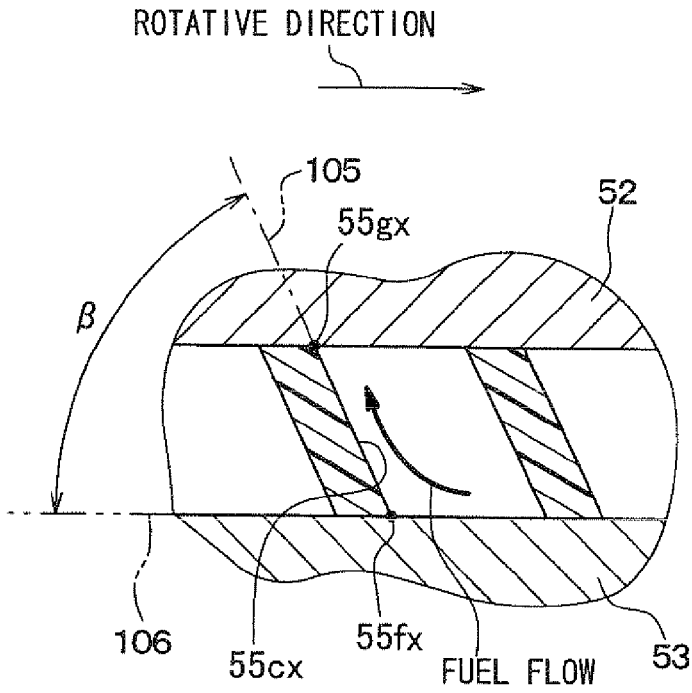
FIG. 9 is a cross sectional view taken along the line IX, XI, XVII, XVIII, XIX-IX, XI, XVII, XVIII, XIX in FIG. 8B.

More specifically, as shown in FIG. 9, the rear surface 55*cx* inclines rearward in the rotative direction from an end at a side of a pump chamber cover 53 to an end at a side of a pump chamber casing 52 in a cylindrical surface around a rotation axis. FIG. 9 is a cylindrical sectional view around the rotation axis taken along the line IX, XI, XVII, XVIII, XIX-IX, XI, XVII, XVIII, XIX in FIG. 8B.

On the cylindrical surface around the rotation axis, an inclination angle β is defined between a line (third line) 105 and a line (fourth line) 106. The line 105 connects the end 55*fx* of the rear surface 55*cx* at the side of the pump chamber cover 53 with the end 55*gx* of the rear surface 55*cx* at the side of the pump chamber casing 52. The line 106 extends from the end 55*fx* at the side of the pump chamber cover 53 in a direction of a tangent at a rear side in the rotative direction. The inclination angle β is in a range of $65° \leqq \beta < 90°$ in the whole area in a radial direction of the rear surface 55*cx*.

In the present embodiment, the inclination angle β is set to be approximately the same in the whole area in the radial direction of the rear surface 55*cx*. Alternatively, one inclination angle β on the cylindrical surface at the radially inner circumferential side may be different from another inclination angle β on the cylindrical surface at the radially outer circumferential side. For example, the inclination angle β may be gradually reduced from the inner circumferential side to the outer circumferential side.

Other configurations are substantially the same as those in the first embodiment. Therefore, when the fuel supply unit 1 of the present embodiment is started, the outer pump chamber 50*a* operates substantially in the same way as in the first embodiment.

Furthermore, in the present embodiment, the inclination angle β of the inner vane groove 55*x* is set to be $65° \leqq \beta < 90°$. In the present structure, when the fuel surface 400 is lower than the pump mounting position 401, and gas (air) fills the inner pump chamber 50*b*, air can be exhausted from the inner pump chamber 50*b*, so that the inner pump chamber 50*b* can produce a certain pump effect.

Figure 10:
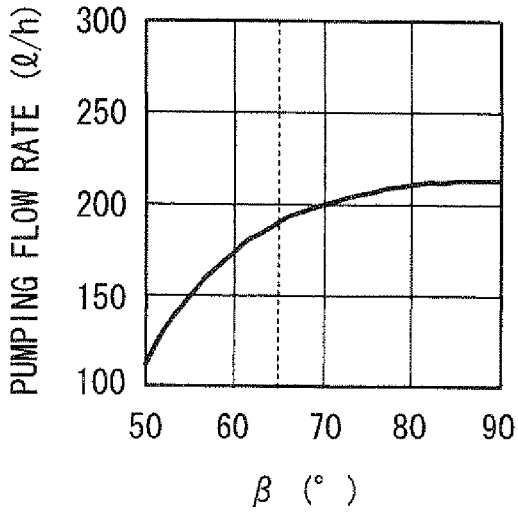
FIG. 10 is a graph showing a relationship between an inclination angle β and a pumping flow rate.

The present operation is described according to FIG. 10. FIG. 10 is a graph showing a relationship between the inclination angle β of the inner vane groove 55*x* and a pumping flow rate of the inner pump chamber 50*b*. A test condition is substantially the same as in the case of FIG. 7. As indicated from FIG. 10, the inclination angle β is set to be $65° \leqq \beta < 90°$, thereby the pumping flow rate can be sufficiently secured. Thus, fuel can be sufficiently pumped up from the fuel tank 10 into the sub-tank 20. On the other hand, when the angle β is set to be $\beta < 65°$, the flow rate of pumping into the inner pump chamber 50*b* is drastically reduced.

When the inclination angle $\beta = 90°$ is given, the rear surface 55*cx* is parallel to the rotation axis direction. In this case, the rear surface 55*cx* of the inner vane groove 55*x* does not incline rearward in the rotative direction from one end side to the other end in the rotation axis direction. Even in this case, as shown in FIG. 10, fuel can be pumped up from the fuel tank 10 into the sub-tank 20.

According to the present embodiment, even when fuel does not exist in the inner pump chamber 50*b*, fuel can be securely pumped up from the fuel tank 10 into the sub-tank 20 at low torque.

Third Embodiment

In the present embodiment, description is made on an example where a shape of a V-shape partition wall 55*a* of the inner vane groove 55 is specified, thereby high pump efficiency ηb can be produced by the inner pump chamber 50*b* compared with the first embodiment.

Figure 11:
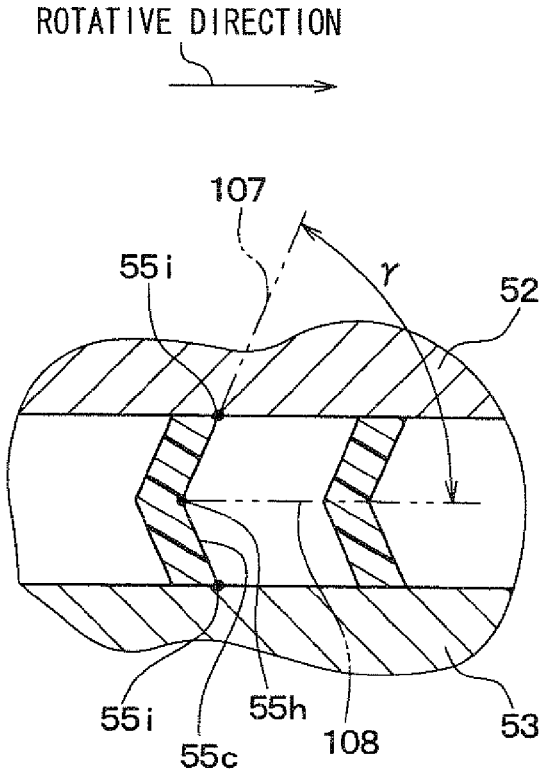
FIG. 11 is a cross sectional view taken along the line IX, XI, XVII, XVIII, XIX-IX, XI, XVII, XVIII, XIX in FIG. 8B in a third embodiment.

Specifically, as shown in FIG. 11, a forward tilt angle γ is defined between a line (ninth line) 107 and a line (tenth line) 108. The line 107 connects a center 55*h* in the rotation axis direction of a rear surface 55*c* on a cylindrical surface around a rotation axis with one of ends 55*i* in the rotation axis direction of the rear surface 55*c*. The line 108 extends in a direction of a tangent at the front side in the rotative direction from the center 55*h* in the rotation axis direction of a rear surface 55*c*. The forward tilt angle γ is in a range of $70° \leqq \gamma < 90°$. FIG. 11 shows a cross sectional view corresponding to a cross sectional view taken along the line IX, XI, XVII, XVIII, XIX-IX, XI, XVII, XVIII, XIX of FIG. 8B in the present embodiment.

Other configurations are substantially the same as in the first embodiment. Therefore, when the fuel supply unit 1 of the present embodiment is started, the outer pump chamber 50*a* operates similarly in the same way as in the first embodiment.

Furthermore, in the present embodiment, since the forward tilt angle γ of the inner vane groove 55 is set to be $70° \leqq \gamma < 90°$, even when the fuel surface 400 is lower than the pump mounting position 401, and gas (air) fills the inner pump chamber 50*b*, pump efficiency of the inner pump chamber 50*b* can be stably maintained high.

Figure 12:
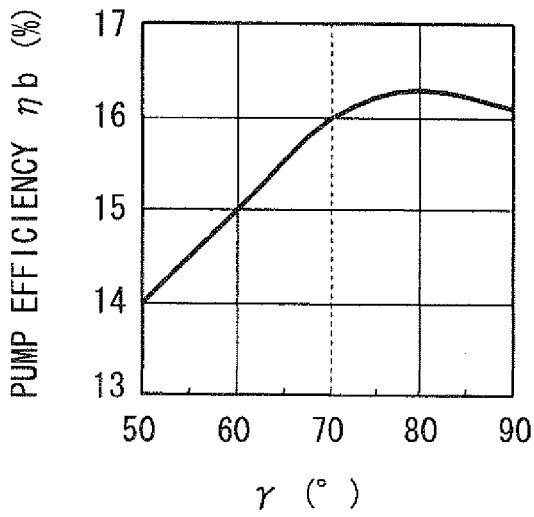
FIG. 12 is a graph showing a relationship between a forward tilt angle γ and pump efficiency.

The present operation is described according to FIG. 12. FIG. 12 is a graph showing a relationship between the forward tilt angle γ of the inner vane groove 55 and the pump efficiency ηb of the inner pump chamber 50*b*. A test condition is substantially the same as in the case of FIG. 7. As indicated from FIG. 12, the forward tilt angle γ is set to be in a range of $70° \leqq \gamma < 90°$, thereby the pump efficiency can be stably maintained high.

The present effect is produced because the forward tilt angle γ is set to be $70° \leqq \gamma < 90°$, thereby fuel can be transported without generating an excessive swirl flow in the inner pump channels 52*c* and 53*c* of the inner pump chamber 50*b* in which fuel need not be excessively increased in pressure. On the other hand, when the angle γ is set to be $\gamma < 70°$, an excessive swirl flow is induced, leading to drastic reduction in pump efficiency.

The pump efficiency ηb of the inner pump chamber 50*b* is given by the following expression F1.

$$\eta b = (P*Q)/(Tb*R) \quad \text{(F1)}$$

P denotes discharge pressure of the inner pump chamber 50*b*, Q denotes the pumping flow rate of the inner pump chamber 50*b*, Tb denotes drive torque of the inner pump chamber 50*b*, and R denotes the number of rotations of the motor portion 40. When the forward tilt angle γ is 90°, while the partition wall 55*a* of the inner vane groove 55 is not in a V shape, high pump efficiency can be produced as shown in FIG. 12.

As described above, according to the present embodiment, even when fuel does not exist in the inner pump chamber 50*b*, fuel can be pumped up from the fuel tank 10 into the sub-tank 20 at low torque while the pump efficiency ηb is stably maintained high.

Fourth to Seventh Embodiments

Fourth to seventh embodiments are modifications of the first to third embodiments respectively. That is, the backward tilt angle α2 between the line 103, which connects the radially inner end 55*d* of the rear surface 55*c* with the radially outer end 55*e* of the rear surface 55*c*, and the line 104, which extends in the radial direction of the impeller 51 from a radially inner end 55*d*, is set in the range of 30°≦α2≦80°, similarly to the embodiments. In the present embodiment, a configuration of a surface to be actually formed into the rear surface 55*c* is modified.

Figure 13:
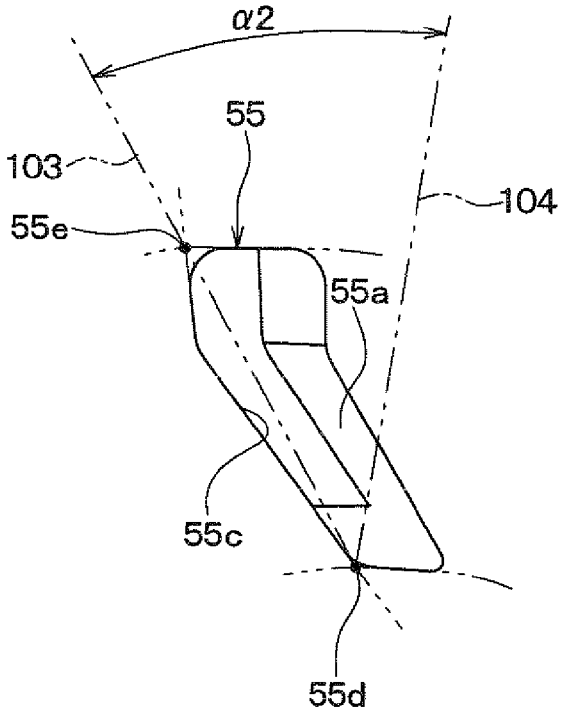
FIG. 13 is an enlarged view of an inner vane groove of an impeller in a fourth embodiment.

Specifically, in the fourth embodiment, as shown in FIG. 13, the inner vane groove 55 is shaped to be R-chamfered at a corner of a peripheral configuration.

Figure 14:
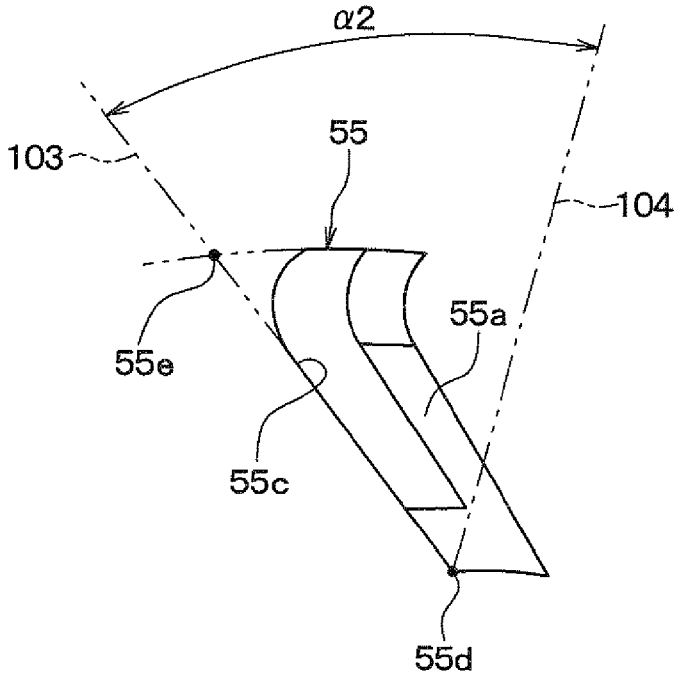
FIG. 14 is an enlarged view of an inner vane groove of an impeller in a fifth embodiment.

In the fifth embodiment, as shown in FIG. 14, a peripheral configuration of the inner vane groove 55 is formed linearly at a radially inner side, and formed arcuately at a radially outer side.

Figure 15:
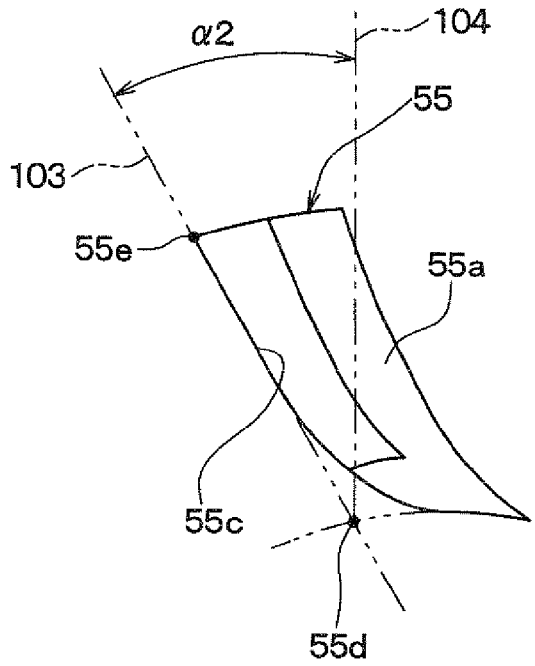
FIG. 15 is an enlarged view of an inner vane groove of an impeller in a sixth embodiment.

In the sixth embodiment, as shown in FIG. 15, a peripheral configuration of the inner vane groove 55 is formed arcuately at a radially inner side, and formed linearly at a radially outer side.

Figure 16:
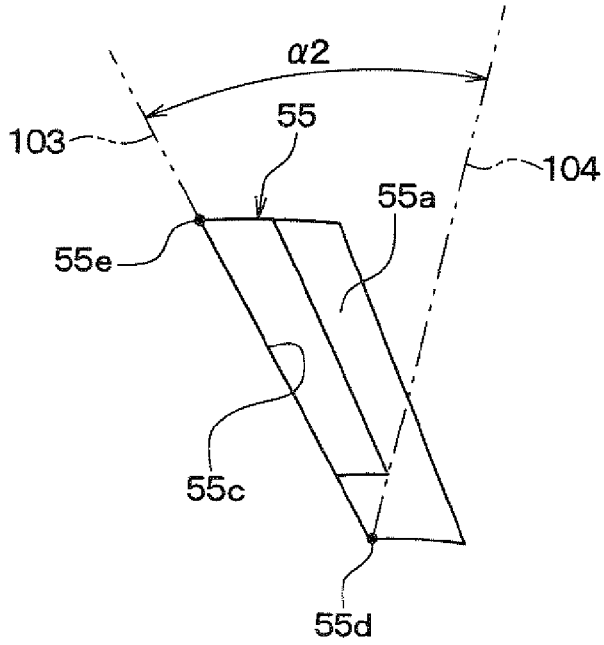
FIG. 16 is an enlarged view of an inner vane groove of an impeller in a seventh embodiment.

Furthermore, in the seventh embodiment, as shown in FIG. 16, a peripheral configuration of the inner vane groove 55 is formed linearly.

FIGS. 13 to 16 are enlarged views showing the inner vane groove 55 in the fourth to seventh embodiments respectively, and the inner vane groove 55 in each embodiment corresponds to the inner vane groove 55 in FIG. 6. In each of the fifth to seventh embodiments, as shown in FIGS. 14 to 16, the radially inner end 55*d* corresponds to an intersection between a circular arc, which is formed by inner diameter side ends of the inner vane grooves 55, and an extension of a linear portion of the rear surface 55*c*. Further, the radially outer end 55*e* corresponds to an intersection between a circular arc formed by outer diameter side ends of the inner vane grooves 55 and the extension of a linear portion of the rear surface 55*c*.

As shown in FIGS. 13 to 16, even when the peripheral configuration of the inner vane groove 55 is modified, the backward tilt angle α2 is set to be the range of 30°≦α2≦80°, thereby the same advantages as in the first to third embodiments can be obtained.

Eighth to Tenth Embodiments

Each of eighth to tenth embodiments are modifications of the second embodiment. That is, on the cylindrical surface around the rotation axis, an inclination angle β is defined between a line 105 and the line 106. The line 105 connects the end 55*fx* of the rear surface 55*cx* at the side of the pump chamber cover 53 with the end 55*gx* of the rear surface 55*cx* at the side of the pump chamber casing 52. The line 106 extends in the direction of the tangent at the rear side in the rotative direction from the end 55*fx* at the side of the pump chamber cover 53. The inclination angle β is in a range of 65°≦β≦90°. In the present embodiment, a configuration of a surface to be actually formed into the rear surface 55*cx* is modified.

Figure 17:
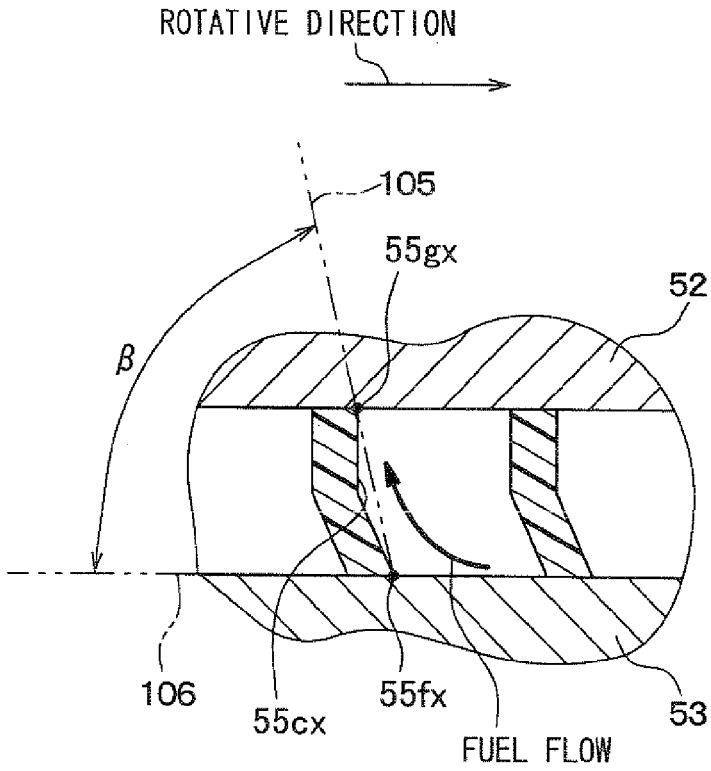
FIG. 17 is a cross sectional view taken along the line IX, XI, XVII, XVIII, XIX-IX, XI, XVII, XVIII, XIX in FIG. 8B in an eighth embodiment.
Figure 18:
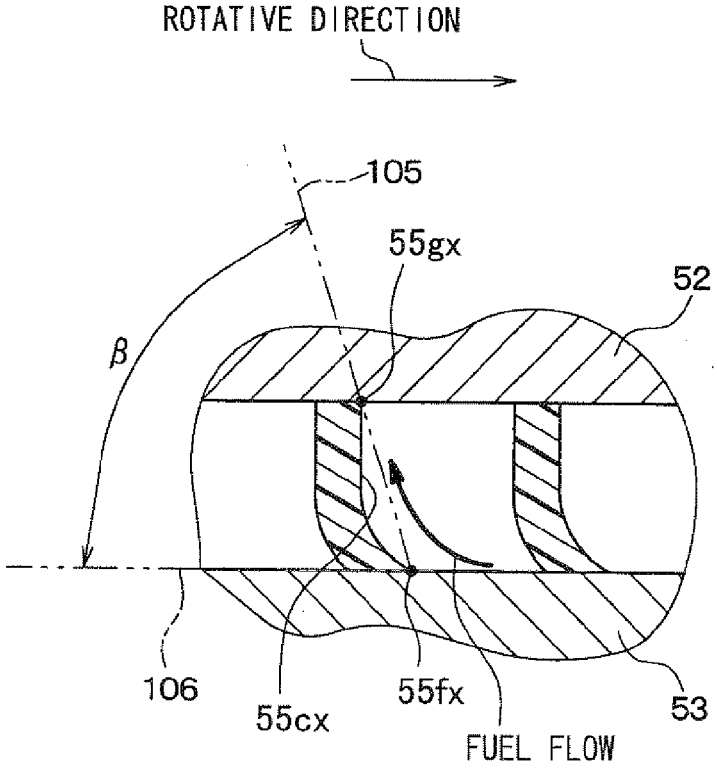
FIG. 18 is a cross sectional view taken along the line IX, XI, XVII, XVIII, XIX-IX, XI, XVII, XVIII, XIX in FIG. 8B in a ninth embodiment.
Figure 19:
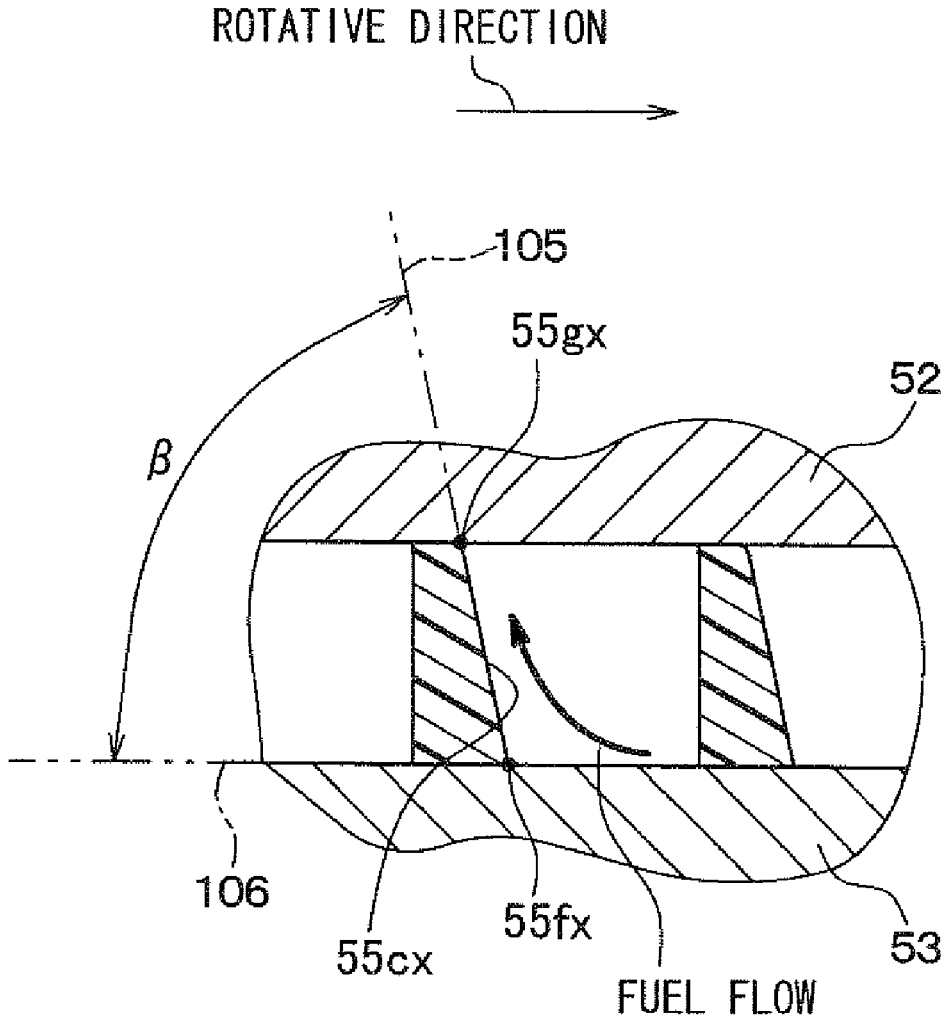
FIG. 19 is a cross sectional view taken along the line IX, XI, XVII, XVIII, XIX-IX, XI, XVII, XVIII, XIX in FIG. 8B in a tenth embodiment.

Specifically, in the eighth embodiment, as shown in FIG. 17, an outer circumferential end of the rear surface 55*cx* is formed by multiple straight lines. In the ninth embodiment, as shown in FIG. 18, the pump chamber cover 53 side of the rear surface 55*cx* is formed by a curved line. Furthermore, in the tenth embodiment, as shown in FIG. 19, substantially only the rear surface 55*cx* is inclined. Each of FIGS. 17 to 19 shows a cross sectional view corresponding to a cross sectional view taken along the line IX, XI, XVII, XVIII, XIX-IX, XI, XVII, XVIII, XIX in FIG. 8B in each of the present embodiments.

As shown in FIGS. 17 to 19, even when the configuration of the outer circumferential end of the rear surface 55*cx* is modified, the inclination angle β is set to be 65°≦β<90°, thereby the same advantage as in the second embodiment can be obtained.

Eleventh Embodiment

Figure 22:
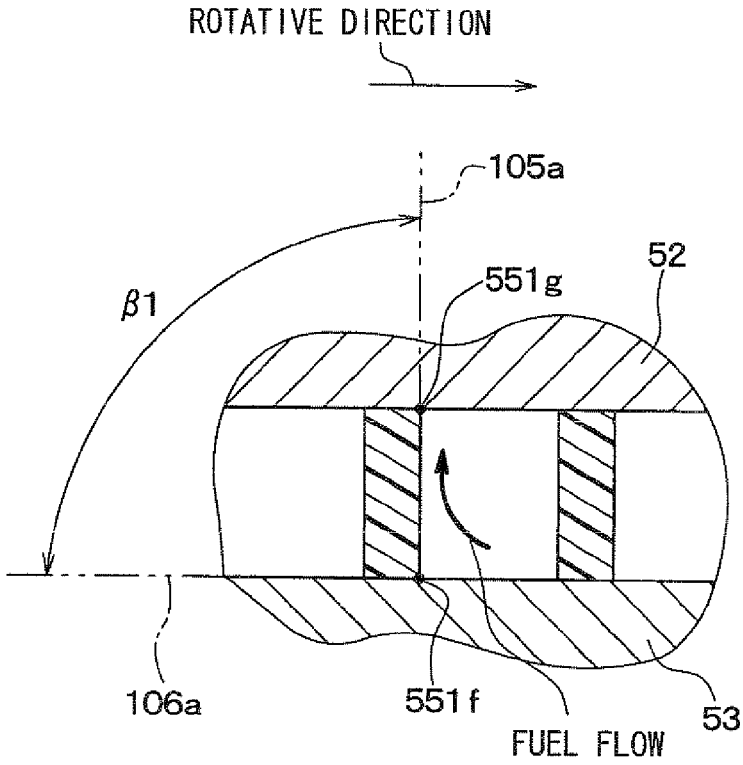
FIG. 22 is a cross sectional view taken along the line XXII-XXII of FIG. 20.
Figure 23:
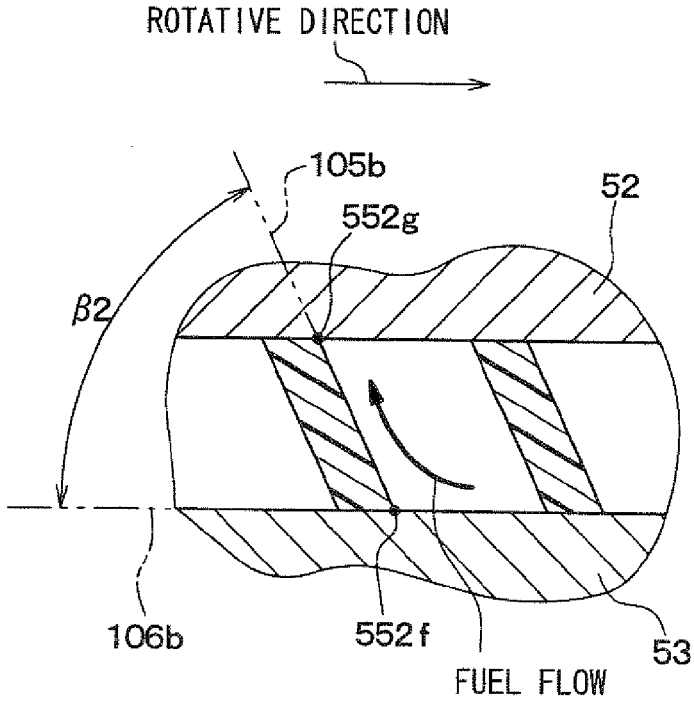
FIG. 23 is a cross sectional view taken along the line XXIV-XXIV of FIG. 20.
Figure 24:
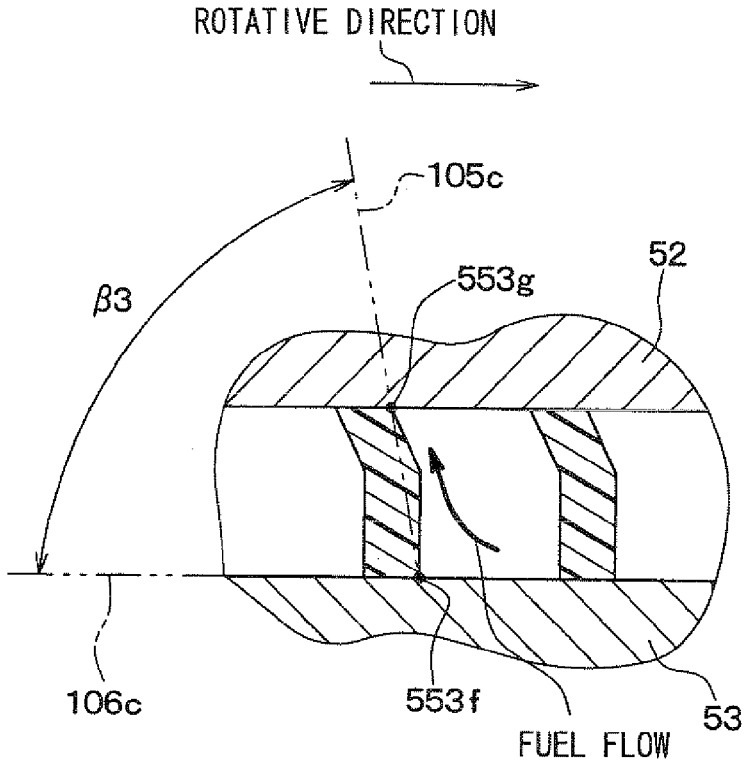
FIG. 24 is a cross sectional view taken along the line XXIII-XXIII of FIG. 20.

The present embodiment includes modifications of the second embodiment. In the second embodiment, description was made on the example where the inclination angle β of the rear surface 55*cx* of the inner vane groove 55*x* was approximately the same in the whole area in the radial direction. On the contrary, in the present embodiment, as shown in FIGS. 22 to 24, description is made on an example where an inclination angle β1 at a radially inner circumferential side of the rear surface 55*cx* is made different from an inclination angle β2 at a radially outer circumferential side of the rear surface 55*cx*.

Figure 20:
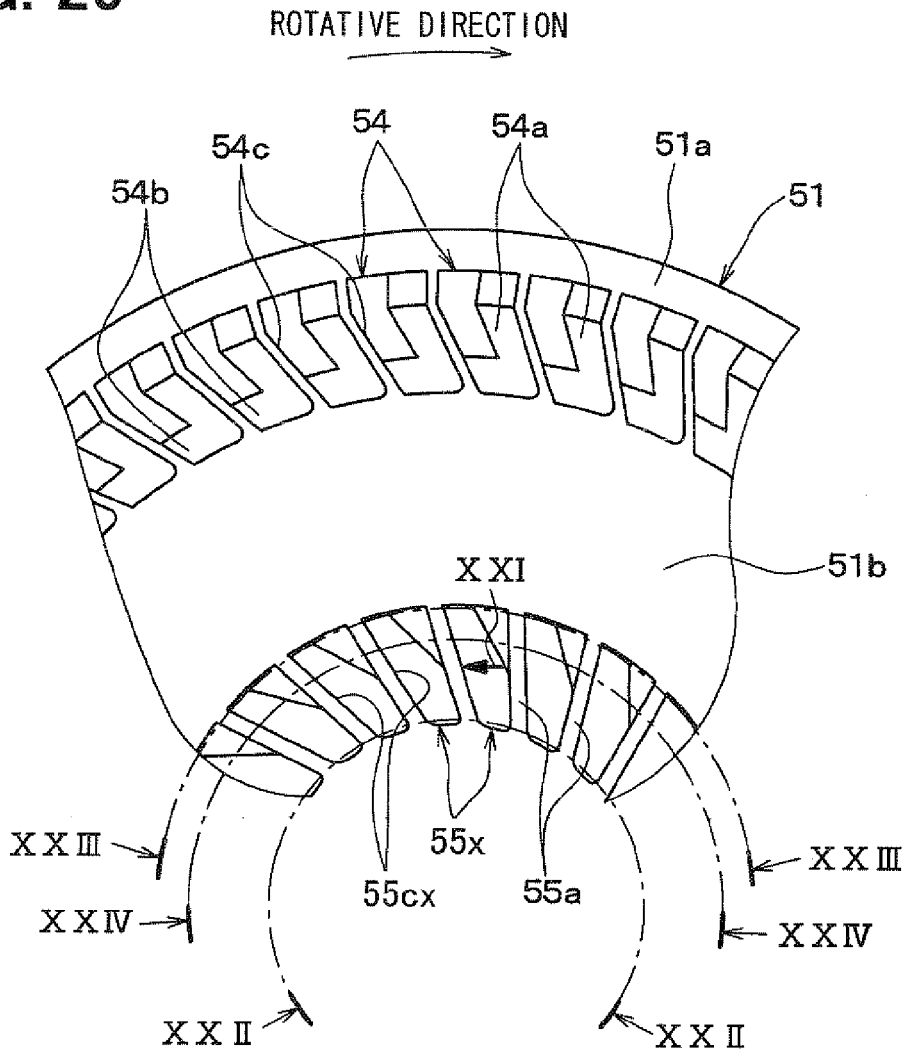
FIG. 20 is an enlarged view of an impeller of an eleventh embodiment.
Figure 21:
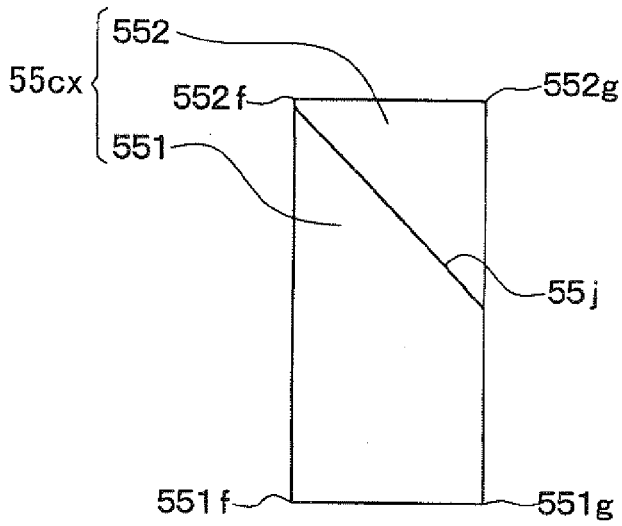
FIG. 21 is a view seen in an arrow XXI direction in FIG. 20.

FIG. 20 is an enlarged view of the periphery of the impeller 51 in the present embodiment, which corresponds to FIG. 8B. FIG. 21 shows a view seen in an arrow XXI direction of FIG. 20, that is, a view of the rear surface 55*cx* seen in the rotative direction. FIGS. 22, 23, and 24 respectively show a cylindrical cross sectional view taken along the line XXII-XXII of FIG. 20, a cylindrical cross sectional view taken along the line XXIII-XXIII of FIG. 20, and a cylindrical cross sectional view taken along the line XXIV-XXIV of FIG. 20, the cylindrical cross sectional views being around the rotation axis.

In the present embodiment, the rear surface 55*cx* is formed by multiple surfaces intersecting with each other. Specifically, the rear surface 55*cx* is formed by two surfaces of an inner area surface 551 and an outer area surface 552. As shown in FIG. 21, the inner area surface 551 intersects with the outer area surface 552 at a bending portion 55*j* extending obliquely with respect to a radial direction.

Furthermore, the inner area surface 551 is formed by a plane parallel to the rotation axis direction. Therefore, as shown in FIG. 22, an inclination angle β1, which is defined between a line (fifth line) 105*a* and a line (sixth line) 106*a*, is given to be β1=90°. Here, the line 105*a* connects an end 551*f*, which is at one end side in the axial direction, with an end 551*g*, which is at the other end side in the axial direction, at a radially innermost circumferential side of the rear surface 55*cx*. The line 106*a* extends in a direction of a tangent at a rear side in the rotative direction from the end 551*f* at the one end side in the axial direction.

On the other hand, the outer area surface 552 is formed by a plane inclining to a rear side in the rotative direction from the bending portion 55*j*. Furthermore, as shown in FIG. 23, an inclination angle β2, which is defined between a line (seventh line) 105*b* and a line (eighth line) 106*b*, is given to be 55°≦β2<90°. The line 105*b* connects an end 552*f*, which is at one end side in the axial direction, with an end 552*g*, which is at the other end side in the axial direction, at a radially innermost circumferential side of the rear surface 55*cx*. The line 106*b* extends in a direction of a tangent at a rear side in the rotative direction from the end 552*f* at the one end side in the axial direction.

In the present structure, the inner area surface 551 and the outer area surface 552 obliquely intersect with each other at the bending portion 55*j*, as shown in FIG. 24. An inclination angle β3, which is defined between a line 105*c* and a line 106*c*, is also given to be 55°≦β3<90°. The line 105*c* connects an end 553*f*, which is at one end side in the axial direction, with an end 553*g*, which is at the other end side in the axial direction, at a radially outer side from an approximately central portion in a radial direction of the rear surface 55*cx*. The line 106*c* extends in a direction of a tangent at a rear side in the rotative direction from the end 553*f* at the one end side in the axial direction.

Other configurations are substantially the same as in the second embodiment. As in the present embodiment, the inclination angle β1 and the inclination angle β2 of the rear surface 55*cx* are respectively modified. Even in the present structure, the inclination angle β2 is set to be 55°≦β2<90°, thereby the similar advantage to in the second embodiment can be obtained.

Figure 25:
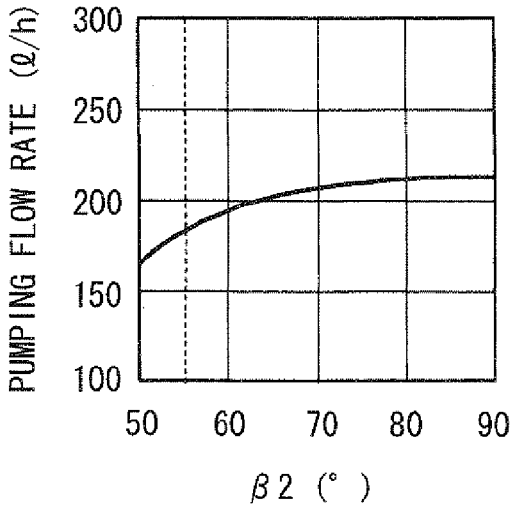
FIG. 25 is a graph showing a relationship between an inclination angle β2 and a pumping flow rate.

The present operation is described according to FIG. 25. FIG. 25 is a graph showing a relationship between the inclination angle β2 of the inner vane groove 55*x* and a pumping flow rate of the inner pump chamber 50*b*. A test condition is substantially the same as in the case of FIG. 7. As indicated from FIG. 25, the inclination angle β2 is set to be 55°≦β2<90°, thereby fuel can be sufficiently pumped up from the fuel tank 10 into the sub-tank 20. On the other hand, when the angle β2 is set to be β2<55°, the pumping flow rate into the inner pump chamber 50*b* is drastically reduced.

Therefore, according to the present embodiment, even when fuel does not exist in the inner pump chamber 50*b*, fuel can be securely pumped up from the fuel tank 10 into the sub-tank 20 at low torque. Furthermore, the inclination angle β2 can be set throughout a wide range compared with the inclination angle β in the second embodiment and the eighth to tenth embodiments, and consequently the degree of design freedom can be enhanced.

In the above description, each of the inner area surface 551 and the outer area surface 552 is formed by a plane in the present embodiment. Alternatively, at least one of the inner area surface 551 and the outer area surface 552 may be formed by a curved surface. Furthermore, substantially only the outer area surface 552 may be formed by a curved surface so that the inner area surface 551 and the outer area surface 552 smoothly intersect with each other.

Other Embodiments

In the embodiments, the partition wall 55*b* is provided in the inner vane groove 55 in the first and third embodiments. Alternatively, the partition wall 55*b* may not be provided as in the second embodiment.

In the first to third embodiments, the outer pump chamber 50*a* is used for feeding fuel under pressure from the sub-tank 20 to the outside of the fuel tank 10, and the inner pump chamber 50*b* is used for filling the sub-tank 20 with fuel from the fuel tank 10. Alternatively, when the outer pump chamber 50*a* is used for filling the sub-tank with fuel, and the inner pump chamber 50*b* is used for feeding fuel under pressure, it suffices that a shape is reversed between the outer vane groove 54 and the inner vane groove 55.

The above structures of the embodiments can be combined as appropriate.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. An impeller for a fuel pump having an outer pump chamber and an inner pump chamber being substantially coaxial with each other, the impeller comprising:

a plurality of partition walls provided at least in a region corresponding to the inner pump chamber and arranged in the rotative direction, each of the plurality of partition walls partitioning inner vane grooves, which are adjacent to each other, wherein a rear surface is located at a rear side in a rotative direction of each of the inner vane grooves, at least a radially inner side of the rear surface inclines rearward in the rotative direction from a radially inner side to a radially outer side, a backward tilt angle α2 defined between (i) a first imaginary line that connects a radially inner end of the rear surface with a radially outer end of the rear surface and (ii) a second imaginary line that extends in a radial direction from the radially inner end of the rear surface, satisfies a relationship of 30° α2≦80°, wherein the rear surface at least partially inclines rearward in the rotative direction from one end side in a rotation axis direction to an other end in the rotation axis direction, the rear surface has a plurality of surfaces intersecting with each other, and the following condition is satisfied:

an inclination angle β1 is different from an inclination angle β2, where the inclination angle β1 is defined between (a) a fifth imaginary line that connects an end at the one end side in an radially innermost side of the rear surface with an end at the other end side in the radially innermost side of the rear surface and (b) a sixth imaginary line that extends in a direction of a tangent toward the rear side in the rotative direction from the end of the rear surface at the one end side in the radially innermost side, and the inclination angle β2 is defined between (c) a seventh imaginary line that connects an end at the one end side in a radially outermost side of the rear surface with an end at the other end side in the radially outermost side of the rear surface and (d) an eighth imaginary line that extends in a direction of a tangent toward the rear side in the rotative direction from the end of the rear surface at the one end side in the radially outermost side.

2. The impeller according to claim 1, wherein the inclination angle β1 satisfies a relationship of β1=90°.

3. The impeller according to claim 1, wherein the inclination angle β2 satisfies a relationship of 55°≦β2≦90°.

4. A fuel pump comprising:

the impeller according to claim 1.

5. A fuel feed apparatus comprising:

the fuel pump according to claim 4, a sub-tank provided in a fuel tank for storing fuel, wherein the sub-tank is configured to store fuel drawn from the fuel tank at a liquid level independent of a liquid level in the fuel tank, and the sub-tank is configured to be supplied with the fuel from the fuel tank by a pump operation of the inner pump chamber of the fuel pump.

* * * * *